US005279613A

United States Patent [19]

Schaffer et al.

[11] Patent Number: 5,279,613

[45] Date of Patent: Jan. 18, 1994

[54] COPOLYMERS BASED ON LONG-CHAIN OLEFINS AND ETHYLENICALLY UNSATURATED DICARBOXYLIC ANHYDRIDES FOR RENDERING LEATHERS AND SKINS WATER-REPELLENT

[75] Inventors: Ortwin Schaffer, Ludwigshafen; Herbert Bay, Reutlingen; Karl Stork, Carlsberg; Norbert Greif, Bobenheim; Knut Oppenlaender, Ludwigshafen; Walter Denzinger, Speyer; Heinrich Hartmann, Limburgerhof, all of Fed. Rep. of Germany

[73] Assignee: BASF Aktiengesellschaft, Ludwigshafen, Fed. Rep. of Germany

[21] Appl. No.: 829,565

[22] Filed: Feb. 5, 1992

Related U.S. Application Data

[63] Continuation of Ser. No. 552,301, Jul. 13, 1990, abandoned.

[30] Foreign Application Priority Data

Aug. 8, 1989 [DE] Fed. Rep. of Germany ..... 3926167

[51] Int. Cl.[5] ..... Q14C 11/00

[52] U.S. Cl. ..... 8/94.1 R; 8/94.21; 8/94.33; 252/8.57

[58] Field of Search ..... 8/98.23, 94.1 R, 94.21, 94.33; 252/8.57; 526/276

[56] References Cited

FOREIGN PATENT DOCUMENTS 0372746 6/2990 European Pat. Off. .
2697748 12/1977 Fed. Rep. of Germany .
3730885 3/1989 Fed. Rep. of Germany .

*Primary Examiner*—Ellen M. McAvoy
*Attorney, Agent, or Firm*—Oblon, Spivak, McClelland, Maier & Neustadt

[57] ABSTRACT

Copolymers which are obtainable by free radical copolymerization of (a) $C_8$--$C_{40}$-monoolefins with (b) ethylenically unsaturated $C_4$-$C_8$-dicarboxylic anhydrides by mass polymerization at from 80° to 300° C. to give copolymers having molecular weights of from 500 to 20,000 g/mol, subsequent solvolysis of the anhydride groups of the copolymers and partial or complete neutralization of the carboxyl groups formed during the solvolysis, in an aqueous medium by means of a base, and which are present in the form of aqueous dispersions or solutions, are used as agents for rendering leathers and skins water-repellent.

11 Claims, No Drawings

COPOLYMERS BASED ON LONG-CHAIN OLEFINS AND ETHYLENICALLY UNSATURATED DICARBOXYLIC ANHYDRIDES FOR RENDERING LEATHERS AND SKINS WATER-REPELLENT

This application is a continuation of application Ser. No. 07/552,301, filed on Jul. 13, 1990, now abandoned.

German Laid-Open Application DOS 3,730,885 discloses fuels for gasoline engines which contain, inter alia, small amounts of copolymers of olefins of 2 to 40 carbon atoms and maleic anhydride and have a molecular weight of from 500 to 20,000 g/mol and in which some or all of the anhydride groups of the copolymers have been reacted with aqueous alkali metal or alkaline earth metal bases and the remainder of the carboxyl groups have been converted with alcohols and/or amines into the corresponding ester and/or amide groups and/or ammonium salts.

German Patent 2,629,748 discloses the use of copolymers of $C_{10}$–$C_{30}$-olefins and maleic anhydride, which are hydrolyzed with alkali metal bases or amines, for filling and fatliquoring leathers and skins. The hydrolyzed copolymers can also be reacted with alkali metal bisulfites. Since the copolymers are prepared in organic solvents and the solvents are not removed, the aqueous copolymer dispersions prepared therefrom contain considerable amounts of organic solvents, for example xylene or dodecylbenzene. Although such dispersions are suitable for fatliquoring leathers and skins, owing to their content of organic solvents they are virtually useless for rendering leathers and skins water-repellent.

It is an object of the present invention to provide an improved agent for rendering leathers and skins water-repellent.

We have found that this object is achieved, according to the invention, by the use of copolymers which are obtainable by free radical copolymerization of (a) $C_8$–$C_{40}$-monoolefins with (b) ethylenically unsaturated $C_4$–$C_6$-dicarboxylic anhydrides, by a mass polymerization method at from 80° to 300° C., to give a copolymer having a molecular weight of from 500 to 20,000 g/mol, subsequent solvolysis of the anhydride groups of the copolymer and partial or complete neutralization of the carboxyl groups formed during the solvolysis, in an aqueous medium by means of a base, and which is present in the form of a 0.5–50% strength by weight aqueous dispersion, as an agent for rendering leathers and skins water-repellent.

The copolymers are disclosed in, for example, German Laid-Open Application DOS 3,730,885. They are prepared by a mass polymerization method by copolymerization of the monomers of group (a) with the monomers of group (b) at from 80° to 300° C. Examples of suitable monoolefins of 8 to 40 carbon atoms are n-oct-1-ene, 2,4,4-trimethylpent-1-ene, 2,4,4-trimethylpent-2-ene, diisobutene, which is available industrially as an isomer mixture of about 80% by weight of 2,4,4-trimethylpent-1-ene and about 20% by weight of 2,4,4-trimethylpent-2-ene, 4,4-dimethylhex-1-ene, dec-1-ene, dodec-1-ene, tetradec-1-ene, hexadec-1-ene, octadec-1-ene, 1-($C_{20}$-olefins), 1-($C_{22}$-olefins), 1-($C_{24}$-olefins), 1-($C_{20}$–$C_{24}$-olefins), 1-($C_{24}$-$C_{28}$-olefins), 1-($C_{30}$-olefins), 1-($C_{35}$-olefins) and 1-($C_{40}$-olefins). The olefins or mixtures of olefins are commercial products. In addition to the straight-chain olefins, cyclic olefins, such as cyclooctene, are also suitable. The olefins may contain small amounts, for example not more than about 5% by weight, of inert hydrocarbons from the preparation. The olefins are usually used in the commercially available quality. They need not be subjected to any special purification. The preferred olefins are $C_{16}$–$C_{30}$-olefins.

Suitable components (b) of the copolymers are monoethylenically unsaturated $C_4$–$C_8$-dicarboxylic anhydrides, eg. maleic anhydride, itaconic anhydride, mesaconic anhydride, citraconic anhydride and methylenemalonic anhydride and mixtures thereof. Among the stated anhydrides, maleic anhydride is preferably used. The copolymers contain from 40 to 60 mol % of monoolefins and from 60 to 40 mol % of the stated dicarboxylic anhydrides as polymerized units and have a molecular weight of from 500 to 20,000, preferably from 800 to 10,000, g/mol. They are obtainable by polymerization of the monomers (a) and (b) in a molar ratio of from 1.1:1 to 1:1. The monomers (a) and (b) are preferably polymerized in a molar ratio of 1:1 or only a 1% by weight excess of monomers of component (a) is used. The monomers of groups (a) and (b) are known to form alternating copolymers which, in the case of high molecular weights, contain 50 mol % of monomers (a) and 50 mol % of monomers (b) as polymerized units. In the case of very low molecular weights of the copolymers, the molar ratio may differ from the abovementioned range, depending on the type of terminal groups, if, for example, the copolymer chain starts with the monomers (a) and also ends with the monomers (a).

Mass polymerization is carried out at from 80° to 300° C., preferably from 120° to 200° C., the lowest polymerization temperature chosen preferably being at least about 20° C. above the glass transition temperature of the polymer formed. The polymerization conditions are chosen according to the desired molecular weight of the copolymers. Polymerization at high temperatures gives copolymers having low molecular weights whereas polymers having higher molecular weights are formed at lower polymerization temperatures. The amount of polymerization initiator also has an effect on the molecular weight. In general, from 0.01 to 5% by weight, based on the monomers used in the polymerization, of free radical polymerization initiators are required. Larger amounts of initiator lead to copolymers having lower molecular weights. At above 200° C., the monomers (a) and (b) can also be copolymerized in the absence of polymerization initiators, ie. it is not absolutely essential to use initiators, because the monomers (a) and (b) undergo free radical polymerization also in the absence of initiators at above 200° C. Examples of suitable polymerization initiators are di-tert-butyl peroxide, acetylcyclohexanesulfonyl peroxide, diacetyl peroxydicarbonate, dicyclohexyl peroxydicarbonate, di-2-ethylhexyl peroxydicarbonate, tert-butyl perneodecanoate, 2,2'-azobis(4-methoxy-2,4-dimethylvaleronitrile), tert-butyl perpivalate, tert-butyl per-2-ethylhexanoate, tert-butyl permaleate, 2,2'-azobisisobutyronitrile, bis-(tert-butylperoxy) -cyclohexane, tert-butyl peroxyisopropylcarbonate, tert-butyl peracetate, di-tert-butyl peroxide, di-tertamyl peroxide, cumene hydroperoxide and tert-butyl hydroperoxide. The initiators can be used alone or as a mixture with one another. In mass polymerization, they are preferably introduced into the polymerization reactor separately or in the form of a solution or dispersion in the monoolefin. In the copolymerization, it is of course also possible to use redox coinitiators, for example benzoin, dimethylaniline, ascorbic acid and complexes of heavy metals, such as copper, cobalt, iron, manganese, nickel and chromium, which complexes are soluble in organic solvents. The presence of redox coinitiators permits the polymerization to be carried out at lower temperatures. The amounts of redox coinitiators usually used are about 0.1–2000 ppm, preferably 0.1–1000 ppm, based on the amounts of monomers used. If the monomer mixture is initially polymerized at the lower limit of the temperature range suitable for the polymerization and then completely polymerized at a higher temperature, it is advantageous to use two or more different initiators which decompose at different temperatures, so that a sufficient concentration of free radicals is available within each temperature range.

In order to prepare low molecular weight polymers, it is often advantageous to carry out the copolymerization in the presence of regulators. Conventional regulators may be used for this purpose, for example $C_1$–$C_4$-aldehydes, formic acid and compounds containing organic SH groups, such as 2-mercaptoethanol, 2-mercaptopropanol, mercaptoacetic acid, mercaptopropionic acid, tert-butyl mercaptan, n-dodecyl mercaptan and tertdodecyl mercaptan. Polymerization regulators are generally used in amounts of from 0.1 to 10% by weight, based on the monomers.

The copolymerization is carried out in conventional polymerization apparatuses, for example a pressure-resistant kettle which is provided with a stirrer, in pressure-resistant stirred kettle cascades or in a tubular reactor. In the case of mass polymerization, the olefins and the anhydrides are copolymerized in an equimolar ratio in the absence of solvents. The copolymerization can be carried out continuously or batchwise. For example, the olefin or a mixture of different olefins may be initially taken in the reactor and heated to the desired polymerization temperature while stirring. As soon as the olefin has reached the polymerization temperature, the ethylenically unsaturated dicarboxylic anhydride is metered in. If an initiator is used, it is metered into the reaction mixture preferably separately or in solution in an olefin used for the polymerization. Where it is used, the polymerization regulator is added to the polymerization mixture either separately or likewise in solution in an olefin. Anhydrides, in particular maleic anhydride, are preferably added in the form of a melt to the reaction mixture. The temperature of the melt is about 70°–90° C. If, in the copolymerization, the olefin is used in excess, for example in a 10% excess, it can be removed from the reaction mixture without difficulties after the end of the copolymerization, by means of distillation, preferably under reduced pressure, from the copolymer melt. The copolymer melt is then advantageously directly further processed.

The copolymers prepared in this manner are subjected to solvolysis after cooling to room temperature or preferably in the form of a melt which is from 80° to 180° C., preferably from 90° to 150° C. Solvolysis of the anhydride groups of the copolymers consist in the simplest case in hydrolysis and subsequent neutralization. It is particularly advantageous to carry out the procedure in pressure-resistant apparatuses and to convert the anhydride groups into carboxyl groups therein directly by the addition of water to a melt of the copolymers obtainable in the mass polymerization, and to neutralize not less than 10% of the carboxyl groups of the hydrolyzed copolymers by subsequent addition of a base. Hydrolysis and neutralization can, however, also be carried out virtually simultaneously by the addition of a dilute aqueous base to the copolymer melt. The amounts of water and neutralizing agent are chosen to give solutions or dispersions which have a solids content of from 10 to 60, preferably from 20 to 55, % by weight and are made commercially available. These are then converted into preparation solutions by dilution to solids contents of from 0.5 to 50% by weight.

The copolymers obtainable by mass polymerization can also be subjected to solvolysis by the addition of primary and/or secondary amines. Solvolysis is carried out using amounts of amines such that from 10 to 50% of the total amount of carboxyl groups formed from the polymerized monomers (b) in the event of complete hydrolysis undergo amidation. After the formation of the semiamide groups in the copolymer, neutralization is carried out. It is continued until not less than 10% of the carboxyl groups of the copolymer obtained in the mass polymerization are neutralized. Furthermore, solvolysis may also be carried out using aminocarboxylic acids and salts of aminocarboxylic acids, preferably the alkali metal salts. Alkali metal salts of α-aminocarboxylic acids are particularly preferably used, the alkali metal salts of sarcosine being very particularly advantageous. Solvolysis by means of salts of aminocarboxylic acids is advantageously carried out in an aqueous medium. Solvolysis is effected using amounts of aminocarboxylates such that from 10 to 50% of the total amount of carboxyl groups formed from the polymerized monomers (b) in the event of complete hydrolysis undergo amidation. After the formation of the semi-amide groups in the copolymer, neutralization is carried out. It is continued until not less than 10% of the carboxyl groups of the copolymer obtained in the mass polymerization are neutralized.

Solvolysis can also be carried out by adding alcohols to a melt of the copolymers obtainable by mass polymerization. The amounts of alcohol used are such that from 10 to 50% of the total amount of carboxyl groups formed from the polymerized dicarboxylic acid units are esterified. Neutralization is subsequently effected, in which not less than 10% of the total amount of carboxyl groups formed from the anhydride-containing copolymer are neutralized.

Preferably, in each case from 25 to 50% of the total amount of carboxyl groups formed from the polymerized dicarboxylic anhydrides undergo amidation or esterification. Examples of suitable neutralizing agents are ammonia, amines, alkali metal and alkaline earth metal bases, for example sodium hydroxide solution, potassium hydroxide solution, magnesium hydroxide, calcium hydroxide, barium hydroxide and all amines which are also used for amidation of the copolymers. Neutralization is preferably effected by adding aqueous sodium hydroxide solution to the copolymer. The neutralization of the anhydride-containing copolymers is carried out at least to a degree such that water-dispersible copolymers are obtained. This degree of neutralization is not less than 10% of the total amount of carboxyl groups formed from the anhydride groups. The degree of neutralization is furthermore dependent on the chain length of the particular olefin of component (a) used. In order to obtain copolymers which are readily water dispersible or soluble to give a colloidal solution, a copolymer of a $C_{30}$-olefin and maleic anhydride is subjected to not less than 75% neutralization, whereas, for example, a copolymer obtained from a $C_{20}/C_{24}$-olefin and maleic anhydride is readily water dispersible when the degree of neutralization corresponds to 50% of the carboxyl groups formed from this copolymer. In a copolymer obtained from a $C_{12}$-olefin and maleic anhydride, a degree of neutralization of only 20% of the carboxyl groups formed from the polymerized maleic anhydride is sufficient for dispersing the copolymer in water.

For amide formation, ammonia and primary and secondary amines may be used. Amide formation is preferably effected in the absence of water by reaction of the anhydride groups of the copolymer with ammonia or amines. The suitable primary and secondary amines may contain 1 to 40, preferably 3 to 30, carbon atoms. Examples of suitable amines are methylamine, ethylamine, n-propylamine, isopropylamine, n-butylamine, isobutylamine, hexylamine, cyclohexylamine, methylcyclohexylamine, 2-ethylhexylamine, n-octylamine, isotridecylamine, tallow fatty amine, stearylamine, oleylamine, dimethylamine, diethylamine, di-n-propylamine, diisopropylamine, di-n-butylamine, diisobutylamine, dihexylamine, dicyclohexylamine, dimethylcyclohexylamine, di-2-ethylhexylamine, di-n-octylamine, diisotridecylamine, di-tallow fatty amine, distearylamine, dioleylamine, ethanolamine, diethanolamine, n-propanolamine, di-n-propanolamine and morpholine. Morpholine is preferably used.

In order to effect partial esterification of the anhydride-containing copolymers obtained in the mass polymerization, the said polymers are reacted with alcohols. The esterification is also preferably carried out in the absence of water. Suitable alcohols may contain 1 to 40, preferably 3 to 30, carbon atoms. Primary, secondary and tertiary alcohols may be used. Both saturated aliphatic alcohols and unsaturated alcohols, for example oleyl alcohol, may be employed. Monohydric, primary or secondary alcohols are preferably used, for example methanol, ethanol, n-propanol, isopropanol, n-butanol, isobutanol, n-pentanol and isomers, n-hexanol and isomers, n-octanol and isomers, such as 2-ethylhexanol, nonanols, decanols, dodecanols, tridecanols, cyclohexanol, tallow fatty alcohol, stearyl alcohol and the alcohols and alcohol mixtures of 9 to 19 carbon atoms which are readily obtainable industrially by the oxo process, for example $C_{9/11}$ oxo alcohol, $C_{13/15}$ oxo alcohol and Ziegler alcohols of 12 to 24 carbon atoms, which are known under the name Alfol. Alcohols of 4 to 24 carbon atoms, eg. n-butanol, isobutanol, amyl alcohol, 2-ethylhexanol, tridecanol, tallow fatty alcohol, stearyl alcohol, $C_{9/11}$ oxo alcohol, $C_{13/15}$ OXO alcohol, $C_{12/14}$ Alfols and $C_{16/18}$ Alfols, are preferably used.

After the partial conversion of the anhydride groups into semi-amide or half-ester groups, hydrolysis of the remaining anhydride groups of the copolymer is carried out. The hydrolysis of the remaining anhydride groups of the copolymer may also be carried out simultaneously with the partial neutralization still required, by adding an aqueous base to the partially amidated or esterified copolymer still containing anhydride groups. The amount of water and bases is chosen so that the concentration of the copolymer dispersion or solution is preferably from 20 to 55% by weight. The pH of the ready-to-use agent for imparting water-repellency is about 4–10.

The aqueous copolymer dispersions thus obtainable are stable and have a long shelf life. They are very suitable for finishing leathers and skins because they have a particularly pronounced action in imparting water-repellency and moreover have a fatliquoring and retanning action. The leather and skin material treated with these copolymer dispersions exhibits only little water absorptivity and water permeability. The dispersions simultaneously act as plasticizers, so that in most cases no additional fatliquoring agents based on natural or synthetic fatliquoring oils are required. The dispersions impart to the product good body and high tensile strength and tear strength, so that additional treatment with commercial retanning agents, for example with vegetable tanning agents or synthetic organic tanning agents (syntans) based on phenolsulfonic acid/phenol/formaldehyde condensates, is no longer necessary in most cases.

Another advantage of the aqueous dispersions to be used according to the invention is that they contain no additional emulsifiers. It is known that leathers and skins which have been treated with emulsifier-containing products must, after treatment with these agents, be subjected to expensive processes, for example after-treatment with polyvalent metal salts, in order to deactivate the emulsifiers in the leather or in the skins.

The copolymer dispersions or copolymer solutions described above are suitable for the treatment of all conventional tanned hides, in particular hides tanned with mineral tanning agents, such as chromium(III) salts. The tanned hides are usually neutralized before the treatment. They may be dyed before the treatment. However, dyeing may also be carried out after the water-repellent treatment effected according to the invention.

The tanned hides are treated with the aqueous dispersions advantageously in an aqueous liquor obtainable by diluting the copolymer dispersions with water, at a pH of from 4 to 10, preferably from 5 to 8, and at from 20° to 60° C., preferably from 30° to 50° C., for from 0.1 to 5, in particular from 0.5 to 2, hours. This treatment is effected, for example, by drumming. The required amount of copolymer dispersion is from 0.1 to 30, preferably from 1 to 20, % by weight, based on the shaved weight of the leather or the wet weight of the skin. The liquor length, ie. the percentage weight ratio of treatment liquor to goods, based on the shaved weight of the leather or the wet weight of the skin, is usually from 10 to 1000%, preferably from 30 to 150%, or from 50 to 500% in the case of skins.

After the treatment with the aqueous liquor described above, the pH of the treatment liquor is brought to 3–5, preferably 3.5–4, by the addition of an acid; organic acids, such as formic acid, are preferably used.

When conventional retanning agents are present during finishing of the leather and of the skin, the treatment with the aqueous dispersions or solutions to be used according to the invention can be carried out before or after the retanning step or as a multistage process, the aqueous dispersions being used proportionately before, during and after the retanning step. The aqueous dispersions to be used as water-repellents may also be employed together with conventional leather and skin finishing agents, such as paraffin-based water-repellent fatliquors. In some cases, this improves the water-repellent, fatliquoring and retanning effect.

In the Examples, percentages are by weight, unless stated otherwise. The molecular weights of the copolymers were determined by gel permeation chromatography, tetrahydrofuran being used as the eluent and polystyrene fractions having a narrow distribution being used for calibration. The treated leathers were tested for water absorptivity and water permeability using a Bally penetrometer according to measurement method IUP 10 of the International Union of the Leather Chemists Associations, Commissions for Physical Leather Testing, cf. das Leder, 12 (1961), 36–40.

Preparation of aqueous copolymer dispersions

Dispersion I

In a steel reactor equipped for polymerizations and provided with a stirrer and metering apparatuses, 1195 g of a 1-($C_{20}$–$C_{24}$-olefin) mixture (Gulftene 20–24, commercial product from Gulf Oil Chemical Company, USA) are initially taken and heated to 190° C. in a gentle stream of nitrogen, while stirring. As soon as this temperature has been reached, 392 g of maleic anhydride, heated to 70° C., are added uniformly and, separately from this, 16 g of di-tert-butyl peroxide are introduced in the course of 4 hours. Thereafter, the reaction mixture is stirred for 2 hours at 190° C. and cooled to 90° C. while stirring. 320 g of 50% strength sodium hydroxide solution and 3909 g of water heated to 90° C. are then added in the course of half an hour, separately from one another. The reaction mixture is stirred for 4 hours at from 90° to 95° C. and then cooled to ambient temperature. This gives a slightly viscous aqueous dispersion having a solids content of 30.2%. The molecular weight of the nonhydrolyzed copolymer of olefin and maleic anhydride is 8900 g/mol, 50 mol % of the total amount of carboxyl groups formed having been neutralized.

Dispersion II

In the reactor in which dispersion I is prepared, 1500 g of octadec-1-ene are initially taken and heated to 190° C. in a nitrogen atmosphere, while stirring. As soon as this temperature has been reached, 588 g of a melt of maleic anhydride and a solution of 27 g of di-tert-butyl peroxide in 42.8 g of octadec-1-ene are each added in the course of 2 hours, separately from one another. After the addition of the maleic anhydride and of the peroxide, the reaction mixture is heated for a further 2 hours at 190° C. and then cooled to 110° C. Thereafter, 522 g of morpholine are metered in over 1 hour. The reaction temperature is kept at 110° C. After the end of the morpholine addition, the reaction mixture is stirred for a further 2 hours at 110° C. in order to convert the anhydride groups of the copolymer into the corresponding semi-amide groups. The stirred reaction mixture is then cooled to 90° C. and 480 g of 50% strength aqueous hydroxide solution and 8680 g of water at 90° C. are added in the course of half an hour, separately from one another, and the mixture is heated for a further 2 hours at 90° C. This gives a dispersion which is viscous at room temperature and has a solids content of 25.4%. The molecular weight of the nonsolvolyzed copolymer is 4800 g/mol, 50 mol % of the total amount of carboxyl groups formed from the anhydride groups being present as amide groups and 50 mol % being present in neutralized form.

EXAMPLE 1

Chrome-tanned ox leather which had a shaved thickness of 1.8 mm and had been brought to a pH of 5.0 was drummed for 2 hours at 40° C. with 15%, based on shaved weight, of dispersion I. The total liquor length was 150%.

Thereafter, the leather was dyed with 1% by weight of a conventional anionic aniline dye. It was then brought to a pH of 3.8 with formic acid, after which it was washed, mechanically set out and dried.

The leather obtained was very soft and supple, had good body, was uniformly dyed and exhibited excellent dynamic water resistance. The test using the Bally penetrometer gave a value of 20.9% for the water absorption after 24 hours at 15% compression and did not indicate any water permeability at this time.

EXAMPLE 2

Chrome-tanned ox leather which had a shaved thickness of 1.8 mm and had been brought to a pH of 5.0 and dyed with 0.7% by weight of a conventional aniline dye was drummed for one and a half hours at 40° C. with 20% of dispersion II, the percentage being based on the shaved weight. After this treatment, the leather was brought to a pH of 3.6 with formic acid and was finished in a conventional manner.

The leather obtained was very soft and supple and exhibited high dynamic water resistance. The test with the Bally penetrometer gave a value of 23.7% for the water absorption after 24 hours at 15% compression and did not indicate any water permeability during this time.

We claim:

1. A process for rendering leathers and skins water-repellant, wherein water-repellency is imparted by applying to leather or a skin a copolymer which is obtained by free radical copolymerization of (a) $C_8$–$C_{40}$-monoolefins with (b) ethylenically unsaturated $C_4$–$C_8$-dicarboxylic anhydrides, by a mass polymerization method in the absence of solvents at from 80° to 300° C., to give a copolymer having a molecular weight of from 500 to 20,000 g/mol, subsequent solvolysis of the anhydride groups of the copolymer and partial or complete neutralization of the carboxyl groups formed during the solvolysis, in an aqueous medium by means of a base, and which is present in the form of an aqueous solution or dispersion.

2. A process as claimed in claim 1, wherein the solvolysis is carried out by adding water to a melt of the copolymer obtainable in the mass polymerization, and not less than 10% of the carboxyl groups of the hydrolyzed copolymer are neutralized with ammonia, an amine or an alkali metal or alkaline earth metal base.

3. A process as claimed in claim 1, wherein the solvolysis is carried out by adding primary and/or secondary amines to a melt of the copolymer obtainable in the mass polymerization, in such a way that from 10 to 50% of the total amount of carboxyl groups formed from the polymerized monomers (b) undergo amidation and not less than 10% of the total amount of carboxyl groups formed are neutralized.

4. A process as claimed in claim 1, wherein the solvolysis of the copolymer obtainable in the mass polymerization is carried out in an aqueous medium by adding a salt of an aminocarboxylic acid, in such a way that from 10 to 50% of the total amount of carboxyl groups formed from the polymerized monomers (b) undergo amidation and not less than 10% of the total amount of carboxyl groups formed are neutralized.

5. A process as claimed in claim 1, wherein the solvolysis is carried out by adding an alcohol to a melt of the copolymer obtainable in the mass polymerization, in such a way that from 10 to 50% of the total amount of carboxyl groups formed from the polymerized monomers (b) are esterified and not less than 10% of the total amount of carboxyl groups formed are neutralized.

6. The process of claim 1, wherein said copolymer is obtained by free radical copolymerization of (a) $C_{16}$–$C_{30}$ monoolefins with (b) maleic anhydride.

7. The process of claim 1, wherein said copolymer contains 40–60mol % of monoolefins and from 60 to 40 mol % of dicarboxylic anhydride.

8. The process of claim 1, wherein said $C_8$–$C_{40}$ monoolefins said ethylenically unsaturated $C_4$–$C_8$ dicarboxylic anhydride are polymerized in a molar ratio of from 1.1:1 to 1:1.

9. The process of claim 1, wherein said aqueous solution or dispersion has a solid contents of from 0.5 to 50% by weight.

10. The process of claim 1, wherein said aqueous solution or dispersion has a pH of from 4 to 10.

11. A process for rendering leathers and skins water-repellant, wherein water-repellency is imparted by applying to leather or a skin, a copolymer which is obtained by free radical copolymerization of (a) a 1-($C_{20}$–$C_{24}$-olefin) mixture with (b) maleic anhydride, by a mass polymerization method in the absence of solvent at from 80° to 300° C. to give a copolymer having a molecular weight of from 500 to 20,000 g/mol, subsequent solvolysis of the anhydride groups of the copolymer and partial or complete neutralization of the carboxyl groups formed during the solvolysis, in an aqueous medium by means of a base, and which is present in the form of an aqueous solution or dispersion.

* * * * *